United States Patent [19]

Jones et al.

[11] 3,999,985

[45] Dec. 28, 1976

[54] CHROMIUM ALLOYS

[75] Inventors: Rodney Charles Jones; Alan Abraham Hershman, both of Wantage, England

[73] Assignee: The British Non-Ferrous Metals Research Association, London, England

[22] Filed: Aug. 28, 1974

[21] Appl. No.: 501,453

Related U.S. Application Data

[62] Division of Ser. No. 289,232, Sept. 15, 1972, Pat. No. 3,841,847.

[52] U.S. Cl. ..... 75/176; 29/182.5

[51] Int. Cl.[2] ..... C22C 27/06; B22F 1/00

[58] Field of Search ..... 75/176, 206; 29/182, 29/182.5

[56] References Cited

UNITED STATES PATENTS 3,841,847 10/1974 Jones et al. ..... 75/176

FOREIGN PATENTS OR APPLICATIONS

| | | | |
|---|---|---|---|
| 2,003,192 | 7/1971 | Germany | 75/176 |
| 963,130 | 7/1964 | United Kingdom | 75/176 |
| 1,179,491 | 1/1970 | United Kingdom | 75/176 |
| 1,206,465 | 9/1970 | United Kingdom | 75/176 |

*Primary Examiner*—C. Lovell

*Attorney, Agent, or Firm*—Wenderoth, Lind & Ponack

[57] ABSTRACT

Alloys for use as components of gas turbine engines have the following composition:

| | |
|---|---|
| Chromium | at least 70% |
| Yttrium | 0.01% to 18% |
| $Y_2O_3$ | up to 18% |
| Aluminium | up to 5% |
| Silicon | up to 8% |
| Aluminium + silicon | at least 0.01% |

The average spacing between yttrium and/or $Y_2O_3$-containing particles is preferably not more than 5 microns.

2 Claims, No Drawings

CHROMIUM ALLOYS

This application is a divisional application from our copending application Ser. No. 289,232, filed Sept. 15, 1972, now U.S. Pat. No. 3,841,847.

The development of new materials for aircraft gas turbine applications is stimulated by the increase in efficiency obtained with higher operating temperatures. Advanced turbines are already operating with gas inlet temperatures close to the melting point of the nickel-based alloys currently used and this is only made possible by air cooling the components. Engineering solutions of this type however incur increased engine complexity and some sacrifice in power output, and a need exists for a material capable of operating satisfactorily at higher temperatures.

The refractory metals (tungsten, molybdenum, tantalum and niobium) have very high melting points and are extremely strong but all oxidise very rapidly. Attempts to develop oxidation resistant coatings have so far proved unsuccessful.

Ceramics (e.g. silicon nitride) have the disadvantage of being brittle at operating temperatures and probably necessitating a design that maintains the components in compression.

Chromium has only a moderately high melting point (1850° C), but has reasonably good oxidation resistance, high elastic modulus, high thermal conductivity and a comparatively low density. Chromium alloy development has already produced simple alloys with higher creep rupture strengths than the highly alloyed nickel-and cobalt-based alloys.

Chromium however has two main disadvantages:

1. It is generally brittle at ambient temperatures.
2. It readily absorbs nitrogen when heated in air at temperatures of interest in gas turbine applications (1100° C).

The embrittlement of chromium is associated with the presence of traces of nitrogen down to very low levels (~ 10 ppm). The problem can be eased by alloying with strong nitride formers (e.g. yttrium and other rare earth elements) and also by suitable warm working procedures. Solid solution strengthening with the refractory metals raises the ductile-brittle transition temperature, but dispersions of some oxides and carbides both strengthen chromium and improve the ductility.

The absorption of nitrogen at service temperatures is probably a more serious problem. The nitrogen not only raises the ductile-brittle transition temperature, but also produces a hard brittle chromium nitride layer beneath the oxide scale. Additions of rare earth elements and of magnesium oxide have been shown to be effective in preventing nitridation under some conditions, but an alloy which is acceptable in service has yet to be produced.

It is known that yttrium additions can reduce oxidation and prevent the formation of a nitride layer in slowly moving air at 1100° C. Protection along these lines is attributed to the incorporation of yttrium in the growing oxide scale, and requires concentrations of yttrium in excess of that which is soluble in chromium. However, the protection afforded by the yttrium is generally found to break down when the alloys are subjected to the action of high-velocity air streams at 1100° C. Such alloys are unsuitable for the manufacture of gas turbine blades. In chromium-yttrium alloys the yttrium is present as a chromium-yttrium eutectic which forms between primary chromium dendrites. In a chill east alloy the mean spacing between such eutectic regions is of the order of 30 microns.

The present invention provides a chromium-based alloy consisting of (apart from impurities):

| | |
|---|---|
| chromium | at least 70% by weight |
| yttrium | 0.91% to 18% by weight |
| $Y_2O_3$ | up to 18% by weight |
| aluminium | up to 5% by weight |
| silicon | up to 8% by weight |

provided that:

aluminium + silicon at least 0.01% by weight yttrium + $Y_2O_3$ + aluminium + silicon not more than 30% by weight.

These alloys are expected to have utility in gas turbine engines. The invention therefore includes components of gas turbine engines, and particularly the moving or stationary blades of such engines, when made of an alloy as defined above.

The alloys of the invention may be divided into two classes, namely:

a. alloys with added yttrium but no added $Y_2O_3$;
b. alloys with added yttrium and added $Y_2O_3$.

Alloys in class (a) have the following composition:

| | |
|---|---|
| chromium | at least 70% by weight |
| yttrium | 0.01% to 18%, preferably 0.25% to 5.0% by weight |
| aluminium | up to 5% by weight |
| silicon | up to 8% by weight |

provided that:

aluminium + silicon at least 0.01%, preferably 0.25% to 5.0% by weight yttrium + aluminium + silicon not more than 30% by weight.

The reasons why aluminium and silicon are capable of imparting improved nitridation resistance to chromium-yttrium alloys are not clear. They may, however, be associated with the formation of intermetallic compounds of the added metals with yttrium, which intermetallic compounds may melt at a higher or lower temperature than the chromium matrix. The following data may be relevant in this connection.

TABLE I

| Element | Al | Si |
|---|---|---|
| Solid solubility Solidus | 27 | 4 |
| (wt. % in Cr) Room temperature | 17 | ~2 |
| Highest melting Compound | $YAl_2$ | $Y_5Si_3$ |
| compound with wt. % Y | 62 | 85 |
| yttrium m.p. ° C, | 1455 | 1850 |
| Other compounds | $Y_2Al$, $Y_3Al_2$ | $Y_5Si_4$, YSi |
| in alloy system | YAl, $YAl_3$ | $Y_3Si_5$ |
| Lowest m.p. at Y-rich end of system | 970 | 1260 |

The alloys of this aspect of the invention may be prepared by arc melting the various ingredients together. Yttrium is substantially insoluble in chromium, and is normally present in yttrium-rich particles dispersed in a chromium matrix. The spacing of the yttrium particles is not critical, but it is preferred that the mean interparticle spacing be kept low, for example below 5 microns. If a very fine yttrium particle spacing is required, this may be achieved by plasma spraying the molten metal mixture in an inert or reducing atmosphere and splat- or water-quenching the molten droplets against a cooled metal surface.

Care has to be taken during a plasma spraying step to avoid excessive oxidation or nitridation of the metal droplets. If the yttrium has not already been oxidised during the splat casting and compacting steps, it may be desirable to oxidise it deliberately in the resulting alloy, so as to prevent possible coarsening of the dispersed yttrium particles at elevated temperatures. Selective oxidation of the yttrium, leaving the chromium unaffected, may be effected by heating the alloy in a controlled atmosphere, for example damp hydrogen.

When the alloy is formed by casting the molten metal, a subsequent extrusion step may result in an improvement of the properties, and particularly of the nitridation resistance.

At least 0.01% by weight of yttrium is required to confer resistance to nitridation on the chromium. Large quantities of yttrium affect the properties of the chromium, and it is preferred to make the minimum addition of yttrium that is consistent with adequate protection of the chromium. A preferred range is from 0.25% to 5.0% by weight of yttrium.

At least 0.01% by weight of aluminium and/or silicon is required to improve the resistance to nitridation of the alloy when subjected to high-velocity air streams at elevated temperature. More than 5% by weight of aluminium would make the alloy excessively brittle. Silicon proportions above 8% by weight confer less resistance to nitridation than do lower silicon concentrations.

EXAMPLE 1

The following alloys were prepared (percentages are by weight):

| | | | | |
|---|---|---|---|---|
| Cr | — | 3% Y | — | 1% Si |
| Cr | — | 3% Y | — | 8% Si |
| Cr | — | 3% Y | — | 2% Al |
| Cr | — | 3% Y | | |

The alloys were prepared by arc melting and were used as cast in all cases.

Specimens of these ternary alloys were exposed for 48 hours at 1100° C. in slowly moving air. Weight gains were measured and all specimens were examined metallographically to determine the nature and degree of oxidation and nitridation.

The results are summarised in Table II. The oxide scale was very thin (~ 2 microns) but internal oxidation and internal nitridation (yttrium blackening) of the yttrium-bearing phase was observed in all cases and the mean depth of penetration, measured from the specimen surface, is given.

The specific weight gains obtained are acceptable in all cases with the exception of unalloyed chromium.

TABLE II

Specific Weight Gain and Magnitude of Attack on Ternary Chromium Alloys after 48 hours in Slowly Moving Air at 1100° C

| Alloy | Depth of Attack from Surface, microns | | | Specific Weight Gain mg/cm² |
|---|---|---|---|---|
| | $Cr_2N$ Layer | $Y_2O_3$ | YN (yttrium blackening) | |
| Cr (unalloyed) | 52 | — | — | 9.00 |

TABLE II-continued

Specific Weight Gain and Magnitude of Attack on Ternary Chromium Alloys after 48 hours in Slowly Moving Air at 1100° C

| Alloy | Depth of Attack from Surface, microns | | | Specific Weight Gain mg/cm² |
|---|---|---|---|---|
| | $Cr_2N$ Layer | $Y_2O_3$ | YN (yttrium blackening) | |
| Cr-3% Y-1% Si | — | 73 | 107 | 1.34 |
| Cr-3% Y-8% Si | — | 77 | 149 | 1.14 |
| Cr-3% Y-2% Al | — | 42 | 102 | 2.40 |
| Cr-3% Y | — | 65 | 103 | 0.50 |

Alloys in class (b) have the following composition:

| | |
|---|---|
| chromium | at least 70% by weight |
| Yttrium | 0.01% to 18%, preferably 0.25% to 5.0%, by weight |
| $Y_2O_3$ | 0.01% to 18% by weight, preferably 0.5% to 15% by volume |
| aluminium | up to 5% by weight |
| silicon | up to 8% by weight |

provided that:

yttrium + $Y_2O_3$ not more than 29.9%, preferably not more than 18%, by weight aluminium + silicon at least 0.01% by weight, preferably 0.25% to 5.0% by weight yttrium + $Y_2O_3$ + aluminium + silicon not more than 30% by weight.

The presence of $Y_2O_3$ in these alloys requires that they be made by powder metallurgy. The techniques discussed in relation to alloys of class (b) are suitable. The yttrium metal may be incorporated by alloying into the chromium metal powder, or may be added separately. It is preferred that the average spacing between neighbouring yttrium-containing particles (i.e. particles comprising yttrium metal or $Y_2O_3$) is not more than 5 microns. It is preferred that the alloy be extruded before use.

EXAMPLE 2

A Cr-3%Y-2%Al-10vol% $Y_2O_3$ alloy billet was produced by arc melting a Cr-3%Y-2%Al alloy followed by crushing, ball milling and sieving. The sub-37 micron fraction was mixed with 'as-received' $Y_2O_3$ (2 micron particle size), isostatically pressed at 550 N/mm² for 10 minutes into a 41 mm dia. cylinder and sintered in flowing, dry hydrogen for 24h at 1150° C. After encapsulation in a 53 mm dia. evacuated mild steel can the billet was extruded at 1200° C with an extrusion ratio of 13:1 (16 mm dia. product). The extrusion exhibited some hot-tearing at the back end but the majority of the product was sound.

This alloy contained a coarse oxide dispersion with a mean interparticle spacing of 9.0 microns transverse to the extrusion direction.

As-extruded specimens exposed to slowly moving air for 48h at 1100° C exhibited a thin adherent oxide scale and a weight gain of 1.8 mg/cm². No $Cr_2N$ layer was identified metallographically.

The behaviour of the alloy in high velocity air was similar to that of the Cr-0.6%Al-10 vol% $Y_2O_3$ alloy (Example 2). Again, a thin, adherent oxide scale was formed with a covering of a powdery oxide and there was no evidence of the formation of a $Cr_2N$ layer.

Specimens of certain alloys according to this invention were rotated in a 'squirrel cage' in the high temperature, high velocity, exhaust gasses from a gas turbine combustion unit. The air was supplied by a centrifugal blower at a mass air flow of 60 lb/min. The fuel was standard aviation kerosene burnt at an air:fuel ratio of 30:1. The temperature of the hottest part of the specimens (centre) was maintained at 1100° C and continuously monitored by a radiation pyrometer previously calibrated against an optical pyrometer.

The complete test consisted of 48h at 1100° C including 17 thermal cycles to room temperature. Heating and cooling during cycling was very rapid, being completed in approximately 1 minute.

The specimens were then examined, particularly to determine the depth of penetration of the chromium nitride layer and of the internal nitridation of the yttrium-rich phase. The results of two sets of tests are set out in Table III below.

TABLE III

| Alloying Components (wt. % unless stated) | Preparation | Depth of Attack in Test Environment: Test 1 $Cr_2N$ | Test 1 YN | Test 2 $Cr_2N$ | Test 2 YN |
|---|---|---|---|---|---|
| 3% Y + 2% Al | | | | | |

TABLE III-continued

| Alloying Components (wt. % unless stated) | Preparation | Depth of Attack in Test Environment: Test 1 $Cr_2N$ | Test 1 YN | Test 2 $Cr_2N$ | Test 2 YN |
|---|---|---|---|---|---|
| + 10 vol % $Y_2O_3$ | PM/E | 0 | 0 | 0 | 0 |
| 3% Y | AM/E | 0 | 2 | 0 | 2 |
| 3% Y + 1% Si | AM/E | 0 | 0 | 0 | 0 |

Key:
PM = powder metallurgy
AM = arc melted
E = extruded
— = type of attack not applicable
0 = nil attack
1 = penetration of $Cr_2N$ less than 5 microns, or penetration of YN less than 200 microns
2 = penetration of $Cr_2N$ greater than 5 microns, or penetration of YN greater than 200 microns.

We claim:

1. A chromium based alloy consisting of, apart from impurities, 3% by weight of yttrium, 10% by volume of $Y_2O_3$, 2% by weight of aluminum and the balance chromium and wherein both yttrium and $Y_2O_3$ is in the form of particles having an average size not exceeding 3 microns and an average spacing not exceeding 5 microns.

2. A chromium based alloy consisting of, apart from impurities, 3% by weight of yttrium, 1% by weight of silicon and the balance chromium and wherein yttrium is in the form of particles having an average size not exceeding 3 microns and an average spacing not exceeding 5 microns.

* * * * *